US012466596B2

(12) United States Patent
Zhou

(10) Patent No.: US 12,466,596 B2
(45) Date of Patent: Nov. 11, 2025

(54) SEPARATION VACUUM SEALER

(71) Applicant: XIAMEN MYLUX INTELLIGENT TECHNOLOGY Co., LTD, Fujian (CN)

(72) Inventor: Yiyun Zhou, Fujian (TW)

(73) Assignee: XIAMEN MYLUX INTELLIGENT TECHNOLOGY Co., LTD, Xiamen (CN)

( * ) Notice: Subject to any disclaimer, the term of this patent is extended or adjusted under 35 U.S.C. 154(b) by 0 days.

(21) Appl. No.: 18/777,511

(22) Filed: Jul. 18, 2024

(65) Prior Publication Data

US 2024/0367836 A1 Nov. 7, 2024

(30) Foreign Application Priority Data

May 30, 2024 (CN) ..... 202421214368.3

(51) Int. Cl.
*B65B 31/04* (2006.01)
*B65B 51/14* (2006.01)

(52) U.S. Cl.
CPC ..... *B65B 31/048* (2013.01); *B65B 51/146* (2013.01)

(58) Field of Classification Search
CPC .... B65B 31/024; B65B 31/048; B65B 51/146
USPC ..... 53/79, 512; 99/472
See application file for complete search history.

(56) References Cited

U.S. PATENT DOCUMENTS

| | | | | |
|---|---|---|---|---|
| 5,784,862 | A * | 7/1998 | Germano | B65B 31/046 53/512 |
| 7,540,127 | B2 * | 6/2009 | Sung | B65B 31/047 53/434 |
| 2004/0128778 | A1 * | 7/2004 | Wong | A61C 17/224 15/28 |
| 2004/0173105 | A1 * | 9/2004 | Kim | B65B 31/047 99/472 |
| 2005/0011166 | A1 * | 1/2005 | Germano | B65B 31/047 53/512 |
| 2005/0022471 | A1 * | 2/2005 | Higer | F04B 49/022 53/512 |

(Continued)

FOREIGN PATENT DOCUMENTS

| | | | | |
|---|---|---|---|---|
| CN | 215323479 U | * 12/2021 | | B65B 31/06 |
| JP | 2002308215 A | * 10/2002 | | B65B 31/02 |
| WO | WO-2023083277 A1 | * 5/2023 | | B65B 51/10 |

*Primary Examiner* — Joshua G Kotis
(74) *Attorney, Agent, or Firm* — Che-Yang Chen

(57) ABSTRACT

The present invention relates to a convenient operation separation type vacuum sealer, which includes a base, a cover, and a handheld device. The cover is flippably connected with the base. A sealing cavity is formed when the base and the cover are closed with each other. The handheld device has a vacuum pumping mechanism disposed thereon. The base has an air suction pipeline arranged therein and connected with the sealing cavity and the vacuum pumping mechanism, and an installation groove provided on one side thereof for assembling the handheld device. The installation groove has a flip cover structure arranged thereon that closes the cover to fix the handheld device and flips the cover to lift the handheld device. The present invention adopts a separation type mechanism, and the vacuum pumping mechanism is installed in the handheld device. The handheld device can be used alone or in combination with the base.

10 Claims, 7 Drawing Sheets

(56) References Cited

U.S. PATENT DOCUMENTS

| | | | | |
|---|---|---|---|---|
| 2005/0183396 | A1* | 8/2005 | Higer | B65B 31/00 53/373.7 |
| 2008/0163592 | A1* | 7/2008 | Tretina | F04C 25/00 53/434 |
| 2018/0164028 | A1* | 6/2018 | Ha | F25D 23/12 |
| 2024/0101292 | A1* | 3/2024 | Zhou | B65B 31/046 |

* cited by examiner

SEPARATION VACUUM SEALER

BACKGROUND OF THE PRESENT INVENTION

Field of Invention

The present invention relates to the technical field of vacuum preservation machines, and more particularly to a separation vacuum sealer.

Description of Related Arts

A vacuum sealer, also known as a vacuum sealing machine, is a kind of machine that uses a vacuum pumping component to extract air from fresh-keeping bags, fresh-keeping boxes, and other food storage containers, and seals the opening to prevent the food inside the vacuum packaging bag from oxidizing or deteriorating due to contact with air, effectively inhibiting the growth of various bacteria and molds and prolonging the shelf life.

In order to adapt to the diversity of fresh-keeping containers on the market, the applicant provides a Chinese invention patent with authorization announcement number CN215323479U, a separated vacuum fresh-keeping machine, the invention adopts a separate structure design, the vacuum extraction mechanism is arranged in a detachable hand-held machine, the hand-held machine can cooperate with the fresh-keeping machine base to vacuum and seal the fresh-keeping bag, and can also be used separately to vacuum the fresh-keeping box, fresh-keeping bottle and other fresh-keeping containers, and the use is flexible and changeable, so as to solve the problem of diversification of fresh-keeping containers.

However, after it was introduced to the market, the applicant found that there are still two problems with the separated vacuum fresh-keeping machine. First, the hand-held machine is installed in a mounting slot on one side of the base, and the hand-held machine is assembled into the mounting slot in a horizontal side insertion manner. This method requires the hand-held machine to be pushed out forcefully when it is separated and disassembled. For hand-held machine, considering the handheld feel and the appearance of the whole machine, there is usually no additional push handle on the hand-held machine. Therefore, the disassembly and separation of the hand-held machine is relatively inconvenient, and the operating experience is poor. Second, the hand-held machine achieves docking by matching the air extraction nozzle with the recessed portion in the mounting slot, and its air tightness is poor, and the problem of air leakage is prone to occur.

SUMMARY OF THE PRESENT INVENTION

The purpose of the present invention is to provide a separation vacuum sealer to solve the above-mentioned problems.

The present invention adopts the following technical solution:

a separation vacuum sealer includes a base, a cover, and a handheld device, wherein the cover is pivotably connected with the base, wherein a sealing cavity is formed when the base and the cover are closed with each other, wherein the handheld device has a vacuum pumping mechanism disposed thereon for extracting air, wherein the base has an air suction pipeline connected with the sealing cavity and the vacuum pumping mechanism and is arranged therein, wherein the base has an installation groove provided on one side thereof for removably coupling with the handheld device, wherein the installation groove includes an opening in a side wall of the base and a flip cover structure arranged thereon that closes the opening to fix the handheld device, wherein the flip cover structure is configured to tilt relative to the side wall of the base to lift the handheld device relative to the installation groove.

Further, the installation groove includes a notch located on a top surface of the base and an opening located on a side wall of the base, wherein the flip cover structure is disposed at the opening of the installation groove.

Further, the flip cover structure includes a flip cover pivotally connected with both sides of the opening of the installation groove, wherein the flip cover includes a side plate and a bottom plate that are integrally injection molded to form an L-shaped structure, wherein the bottom plate has a flip base located at a bottom, wherein the flip base has a flip rail arranged thereon so that the flip cover flips along the flip rail, wherein the flip rail has two stop concave points respectively provided at two ends thereof, wherein the installation groove has a spring holding column mechanism fixedly installed in the opening thereof, wherein the spring holding column mechanism is located in the flip rail to limit the movement of the flip cover, and when the spring holding column mechanism is located at one of the two stop concave points, the flip cover structure fixes or lifts the handheld device.

Preferably, the stop concave points are respectively a lid closing concave point located at the upper end of the flip rail and a lid flip concave point located at the lower end of the flip rail.

Preferably, the spring holding column mechanism includes a holding base locked at the bottom of the opening of the installation groove, a holding column passing through the holding base, and a return spring sleeved on the holding column.

Further, the handheld device includes a casing, a vacuum pumping mechanism provided inside the casing, and a suction nozzle fixedly provided at the end of the casing and cooperating with the vacuum pumping mechanism, wherein the installation groove includes a suction interface provided on the inner side wall thereof and cooperating with the suction nozzle, wherein the suction interface is connected with the air suction pipeline.

Preferably, a sealing ring is fixedly provided on the suction interface for grasping and sealing the suction nozzle, wherein the sealing ring is an arc-shaped silicone sealing ring.

Preferably, the handheld device includes a battery module provided therein, wherein a key switch and a signal contact point for charging and signal control are arranged on the casing, wherein the installation groove includes a signal contact element arranged therein and matched with the signal contact point.

Preferably, a plurality of friction protrusions are provided on the side walls of both sides of the casing to abut against the inner side walls of both sides of the installation groove.

Further, a heating sealing mechanism provided on one side of the sealing cavity of the base, wherein the base has a sealing button provided thereon for controlling the heating sealing mechanism and a vacuum key provided thereon for controlling the vacuum pumping mechanism.

From the above description of the structure of the present invention, it can be seen that compared with the prior art, the present invention has the following advantages:

1. The present invention adopts a separation type mechanism design, placing the vacuum pumping mechanism in the handheld device. The handheld device can be used alone or in conjunction with the base. At the same time, the installation groove of the handheld device includes an opening in a side wall of the base and a flip cover structure arranged thereon that closes the opening to fix the handheld device, wherein the flip cover structure is configured to tilt relative to the side wall of the base to lift the handheld device relative to the installation groove, the handheld device can be quickly and conveniently taken or placed through the flip cover structure, the operation is simple and convenient, and the assembly is stable and reliable.
2. In the present invention, an arc-shaped silicone sealing ring is provided on the suction interface of the base. When the suction nozzle of the handheld device is connected to the suction interface, the arc-shaped silicone sealing ring is used to grasp and seal the suction nozzle, thereby ensuring the reliability of the connection between the base and the handheld device and the airtightness of the vacuuming.
3. When the flip cover of the present invention is closed, the recessed portion of the side plate grasps the tail of the handheld device, the arc-shaped silicone sealing ring of the suction interface grasps the suction nozzle, and the friction protrusions resist the inner walls of both sides of the installation groove, thereby holding and fixing the handheld device from multiple angles and all directions, so that the assembly of the handheld device is more stable and reliable.

Figure 1:
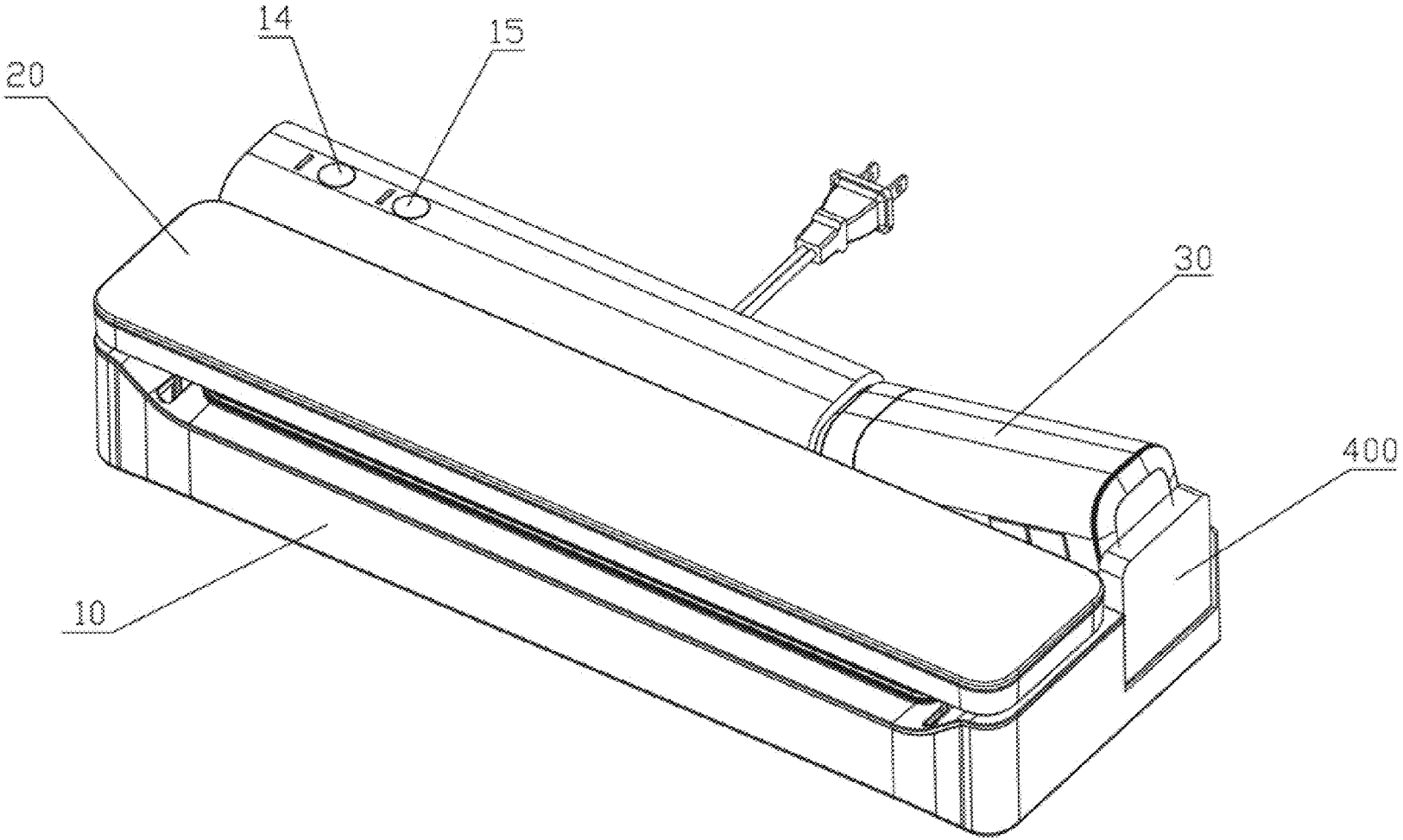
FIG. 1 is a perspective view of the present invention.

Wherein, the numbers in the figure are: base 10, sealing cavity 11, installation groove 12, groove portion 121, suction interface 122, sealing ring 123, signal contact element 124, lower sealing gasket 13, sealing button 14, vacuum key 15, air suction pipeline 16, cover 20, upper sealing gasket 21, handheld device 30, casing 31, vacuum pumping mechanism 32, suction nozzle 33, friction protrusions 34, key switch 35, signal contact point 36, flip cover 400, side plate 410, recessed portion 411, bottom plate 420, flip base 430, flip rail 431, lid closing concave point 432, lid flip concave point 433, spring holding column mechanism 440, holding base 441, holding column 442, return spring 443, heating sealing mechanism 50.

DETAILED DESCRIPTION OF THE PREFERRED EMBODIMENT

Specific implementation modes of the embodiments of the present invention will be described below with reference to the accompanying drawings.

Figure 2:
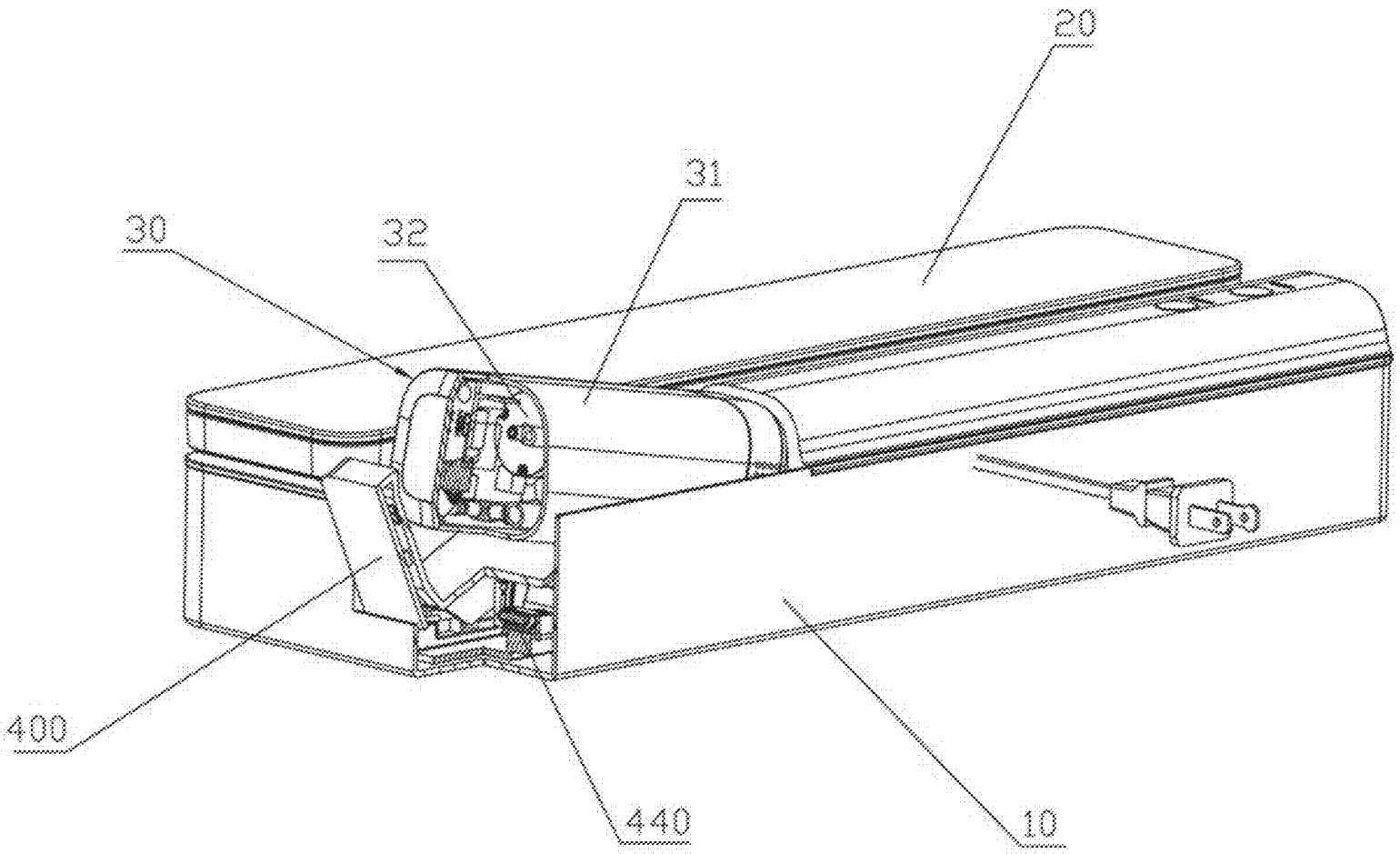
FIG. 2 is a partial sectional view of the flip cover structure of the present invention.

Referring to FIGS. 1 and 2, a separation vacuum sealer includes a base 10, a cover 20, and a handheld device 30, wherein the cover 20 is pivotably connected with the base 10, wherein a sealing cavity 11 is formed when the base 10 and the cover 20 are closed with each other, wherein the handheld device 30 has a vacuum pumping mechanism 32 disposed thereon for extracting air, wherein the base 10 has an air suction pipeline 16 connected with the sealing cavity 11 and the vacuum pumping mechanism 32 and is arranged therein, wherein the base 10 has an installation groove 12 provided on one side thereof for removably coupling with the handheld device 30, wherein the installation groove 12 includes an opening in a side wall of the base and a flip cover structure arranged thereon that closes the opening to fix the handheld device 30, wherein the flip cover structure is configured to tilt relative to the side wall of the base to lift the handheld device 30 relative to the installation groove. In other words, when the flip cover structure is closed, the handheld device 30 is fixed, and when the flip cover structure is opened, the handheld device 30 is lifted.

Figure 3:
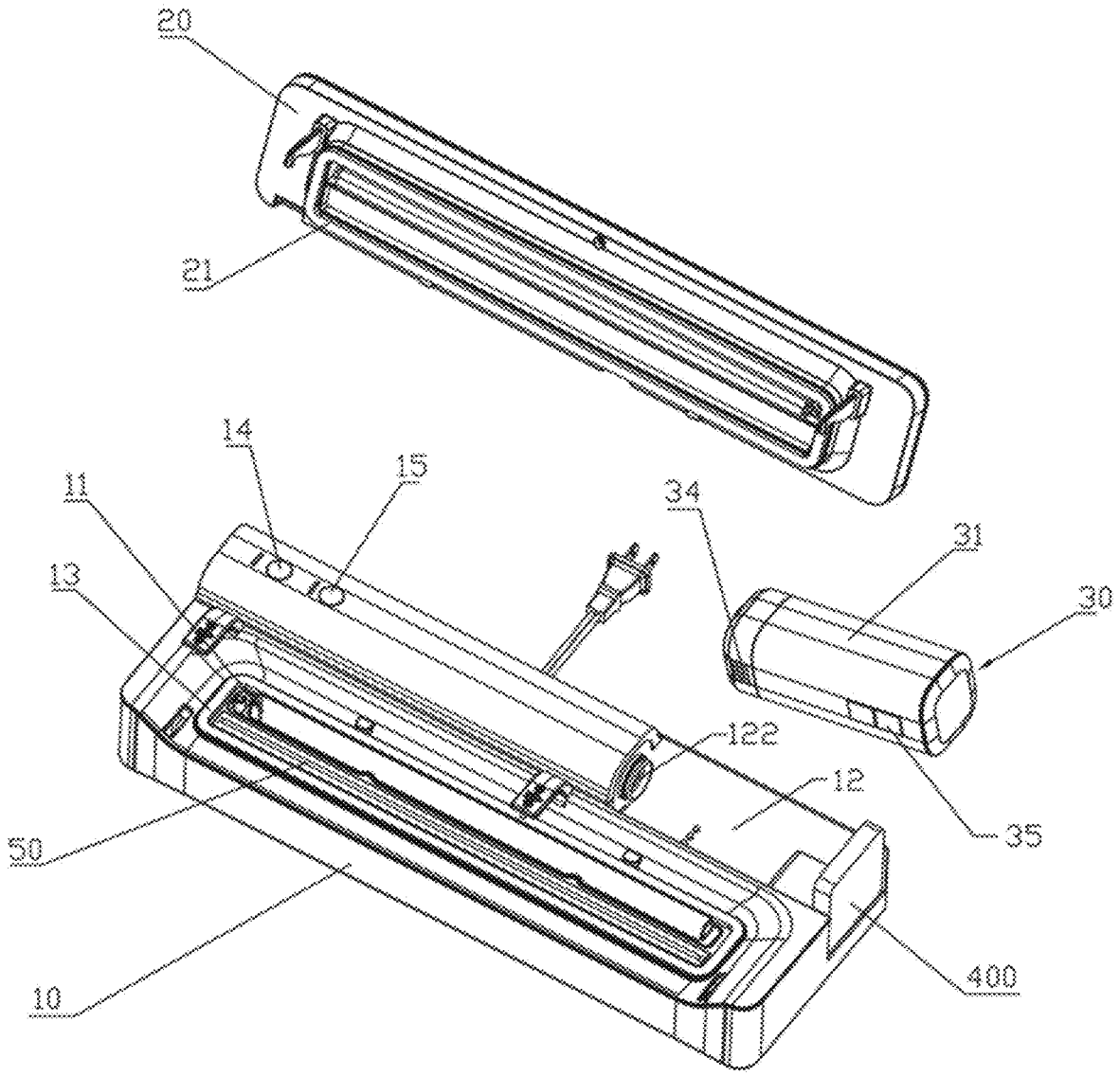
FIG. 3 is an exploded view of the present invention.
Figure 4:
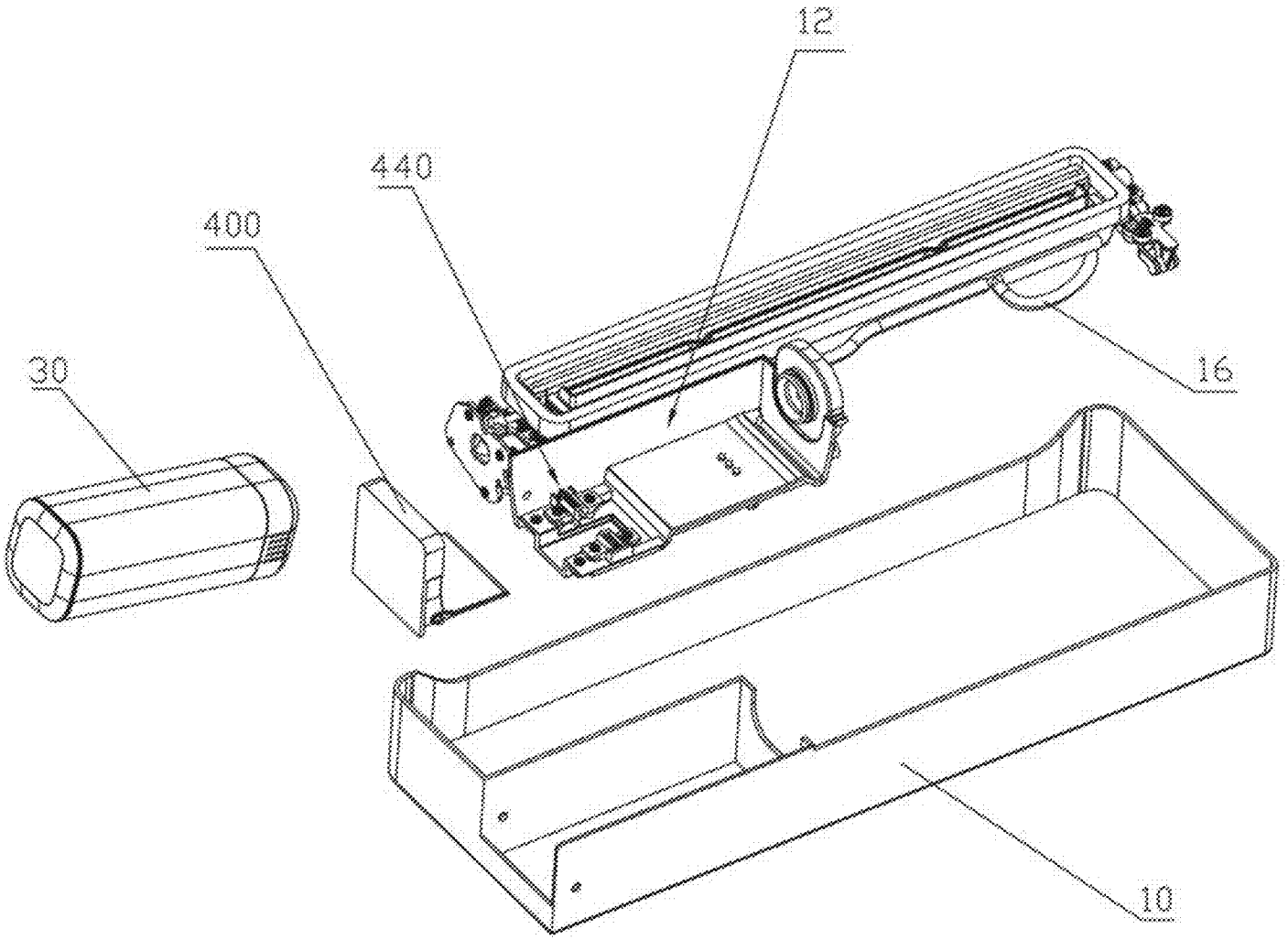
FIG. 4 is an exploded view of the base of the present invention.

Specifically, referring to FIG. 1 and FIG. 3, the cover 20 is hingedly connected with the base 10 through a hinge or a pivot pin, wherein a lower sealing gasket 13 and an upper sealing gasket 21 are respectively arranged around the sealing cavity 11 formed by the base 10 and the cover 20, wherein the upper sealing gasket 21 and the lower sealing gasket 13 are attached to each other when the cover 20 is closed, and while mating with the sealing cavity 11 for vacuuming the sealed bag, it also further ensures its airtightness and improves the vacuuming efficiency and effect.

In addition, referring to FIG. 3, a heating sealing mechanism 50 provided on the side of the sealing cavity 11 of the base 10, wherein the base 10 has a sealing button 14 provided thereon for controlling the operation of the heating sealing mechanism 50. In this embodiment, the specific structure and working principle of the heating sealing mechanism 50 belong to the conventional technology. Those skilled in the art can refer to the structure and working principle of the conventional vacuum fresh-keeping machine for implementation, so it is not repeated herein.

Referring to FIGS. 2 and 3, in the present invention, the installation groove 12 is provided on the top of the base 10. The installation groove 12 includes a notch located on a top surface of the base 10 and an opening extending to a side wall of the base 10. The flip cover structure is disposed at the opening of the installation groove 12.

Referring to FIGS. 2 to 6, the flip cover structure includes a flip cover 400, wherein the flip cover 400 is pivotally connected with the inner side walls on both sides of the opening of the installation groove 12. The flip cover 400 includes a side plate 410 and a bottom plate 420 that are integrally injection molded to form an L-shaped structure. The bottom plate 420 is arranged at the bottom of the opening of the installation groove 12, and the side plate 410 blocks the opening of the installation groove 12 to form a cover plate located at the opening. In order to better fix the handheld device 30 when the flip cover 400 is closed, in this embodiment, the side plate 410 has a recessed portion 411 on the side facing the handheld device 30 for fixing the tail of the handheld device 30.

Figure 5:
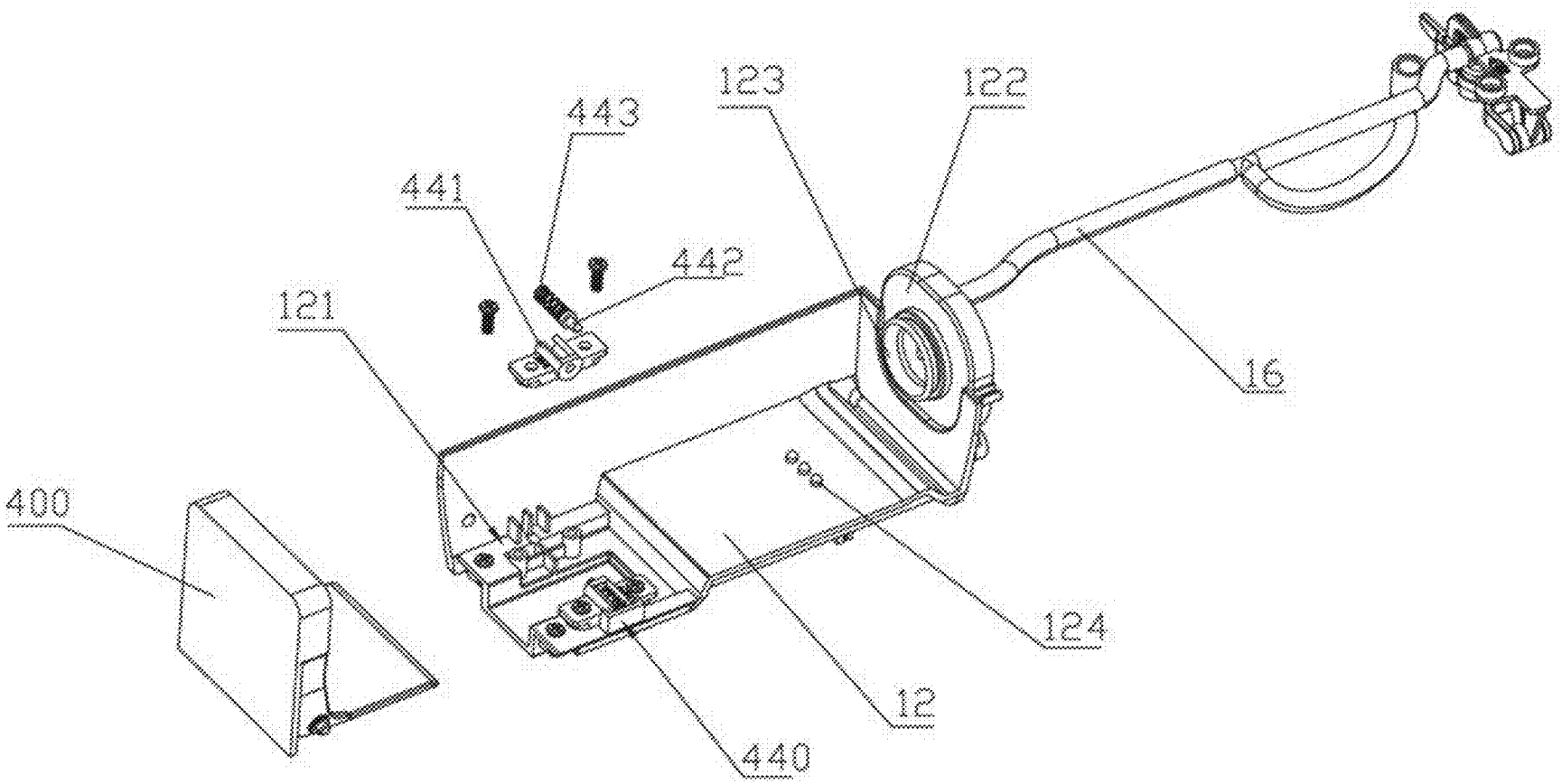
FIG. 5 is an exploded view of the sealing cavity and flip cover structure of the present invention.
Figure 6:
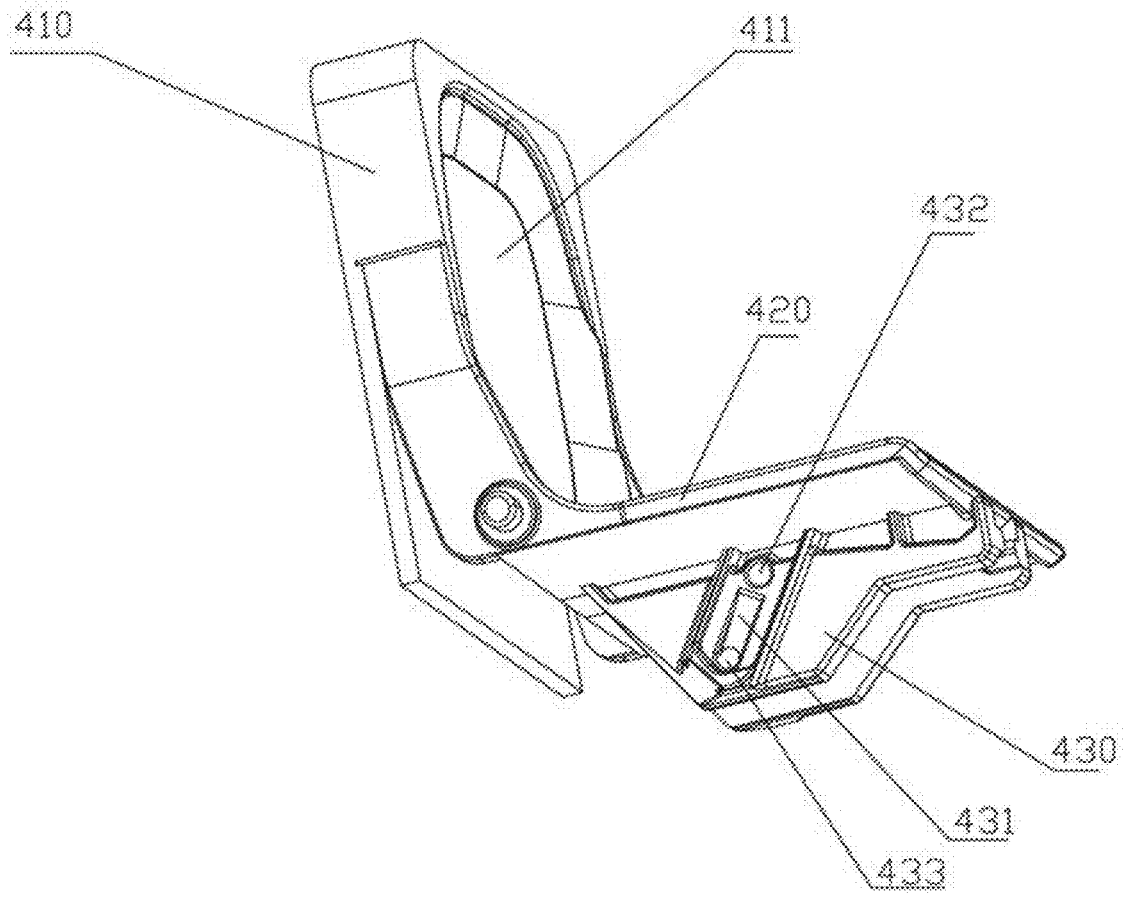
FIG. 6 is a perspective view of the flip cover of the present invention.

Referring to FIGS. 5 and 6, the bottom plate 420 has a flip base 430 located at the bottom. The flip base 430 has a flip rail 431 arranged thereon that is consistent with the flip trajectory of the flip cover 400. The flip rail 431 has two stop concave points respectively provided at two ends thereof. The stop concave points are respectively a lid closing concave point 432 located at the upper end of the flip rail 431 and a lid flip concave point 433 located at the lower end of the flip rail 431. The installation groove 12 has a spring holding column mechanism 440 that matches the flip rail 431 and the stop concave points, and is fixedly installed in the opening thereof. The spring holding column mechanism 440 includes a holding base 441 locked at the bottom of the opening of the installation groove 12, a holding column 442 passing through the holding base 441, and a return spring 443 sleeved on the holding column 442.

Referring to FIG. 5, in this embodiment, in order to make the flip of the flip base 430 more stable and smooth, the spring holding column mechanism 440 is preferably two, and the two sides of the flip base 430 are respectively arranged, and the corresponding flip rail 431 and stop concave points are symmetrically arranged on both sides of the flip base 430. Furthermore, in order to ensure that the handheld device 30 can be assembled smoothly, in this embodiment, the installation groove 12 has a groove portion 121 provided at the opening position thereof, and the above-mentioned spring holding column mechanism 440 is respectively locked on both sides of the groove portion 121 through screw, the flip base 430 is accommodated in the groove portion 121, and the bottom plate 420 covers the groove portion 121 and is flush with the bottom of the installation groove 12.

Figure 7:
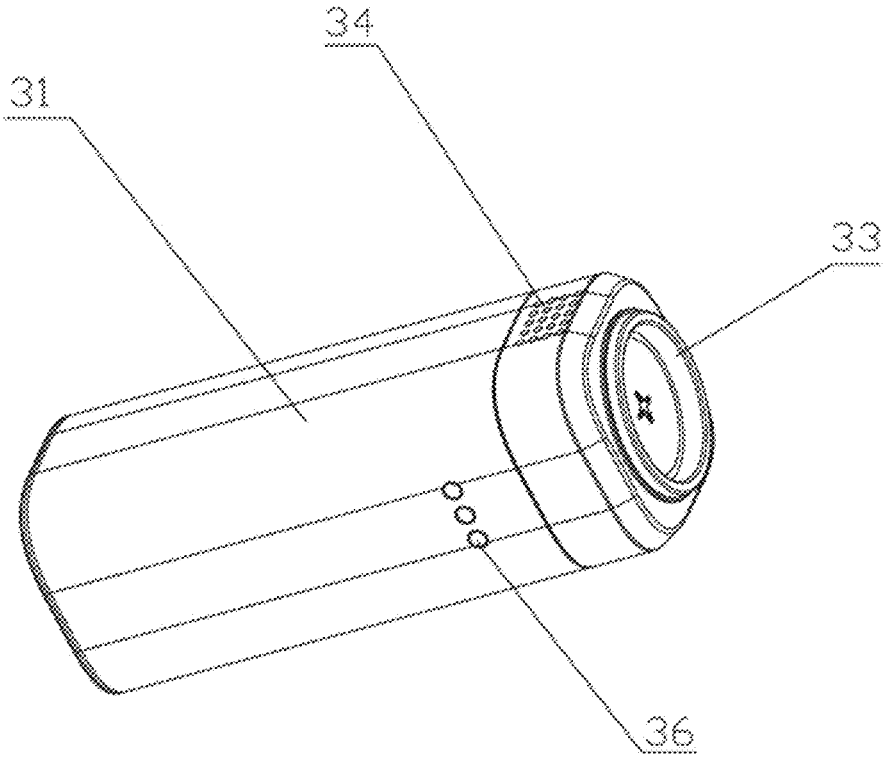
FIG. 7 is a perspective view of the handheld device of the present invention.

Referring to FIGS. 2, 3 and 7, in order to facilitate the user to hold the handheld device 30, the handheld device 30 adopts a long strip structure such as a cylinder or a cuboid. In this embodiment, a cuboid structure with rounded edges and corners is preferred. The handheld device 30 includes a casing 31, and a vacuum pumping mechanism 32 and a battery module (not shown in the figure) provided inside the casing 31, in this embodiment, the vacuum pumping mechanism 32 is a vacuum pump, the battery module is preferentially but not limited to the storage battery, the battery module can also be a dry battery, an aluminum battery and other battery modules, and the specific structure and model of the vacuum pump are selected according to actual demand.

Referring to FIGS. 3, 5 and 7, the handheld device 30 includes a suction nozzle 33 fixedly provided at the end of the casing 31 thereof and cooperating with the vacuum pump, wherein the installation groove 12 includes a suction interface 122 provided on the inner side wall thereof and cooperating with the suction nozzle 33, wherein the suction interface 122 is connected with the air suction pipeline 16. In order to further improve the air tightness between the base 10 and the handheld device 30, a sealing ring 123 for grasping and sealing the suction nozzle 33 is fixedly provided on the suction interface 122 in this embodiment, and the sealing ring 123 is preferably an arc-shaped silicone sealing ring 123 structure. When the handheld device 30 is assembled in the installation groove 12, the sealing ring 123 made of arc-shaped silicone can well wrap and grasp the suction nozzle 33, thereby ensuring the connection reliability between the base 10 and the handheld device 30 and the airtightness of vacuum extraction.

Referring to FIGS. 3 and 7, in order to further improve the assembly stability of the handheld device 30 and the installation groove 12, in this embodiment, a plurality of friction protrusions 34 are provided on the side walls of both sides of the casing 31 to abut against the inner side walls of both sides of the installation groove 12. For the convenience of operation, in this embodiment, a key switch 35 is provided on the casing 31 for directly controlling the operation of the vacuum pumping mechanism 32, and a vacuum key 15 is also provided on the base 10 for controlling the operation of the vacuum pumping mechanism 32. At the same time, a signal contact point 36 is arranged on the casing 31 for charging and signal control, wherein the installation groove 12 includes a signal contact element 124 matched with the signal contact point 36 and correspondingly arranged therein, wherein the signal contact element 124 is preferably a signal contact element 124 with a telescopic structure. In this embodiment, the power module, vacuum pumping mechanism 32, key switch 35, signal contact point 36, signal contact element 124 and other structures, their specific connection circuits and connection structures are conventional technologies and will not be described again here.

Referring to FIGS. 1 to 7, when the handheld device 30 of the present invention is used alone, the flip cover 400 is turned to tilt the bottom plate 420 upward, and the holding column 442 slides down along the flip rail 431, and finally sinks into the lid flip concave point 433 for limiting and fixing. When the bottom plate 420 is tilted upward, the tail of the handheld device 30 can be lifted, so that the user can easily take the handheld device 30 and use it alone. When the present invention is used in combination, the suction nozzle 33 at the end of the handheld device 30 is placed against the suction interface 122, and then the handheld device 30 is pressed and released, so that the bottom plate 420 is pressed down, the flip cover 400 is closed, and the holding column 442 slides up along the flip rail 431, and finally sinks into the lid closing concave point 432 for limiting and fixing. At the same time, the recessed portion 411 of the side plate 410 grasps the tail of the handheld device 30, the arc-shaped silicone sealing ring 123 on the suction interface 122 grasps and seals the suction nozzle 33, and the friction protrusions 34 resist the inner walls of both sides of the installation groove 12. Thus, the fixed handheld device 30 is held from multiple angles and in all directions.

The above are only the specific embodiments of the present invention, but the design concept of the present invention is not limited thereto, and any non-substantial modification of the present invention by using this concept shall be an act of infringing the scope of protection of the present invention.

What is claimed is:

1. A separation vacuum sealer, comprising: a base, a cover, and a handheld device, wherein the cover is pivotably connected with the base, wherein a sealing cavity is formed when the base and the cover are closed with each other, wherein the handheld device has a vacuum pumping mechanism disposed thereon for extracting air, wherein the base has an air suction pipeline connected with the sealing cavity and the vacuum pumping mechanism and is arranged therein, wherein the base has an installation groove provided on one side thereof for removably coupling with the handheld device, wherein the installation groove comprises an opening in a side wall of the base, a flip cover structure arranged thereon that closes the opening to fix the handheld device, wherein the flip cover structure is configured to tilt relative to the side wall of the base to lift the handheld device relative to the installation groove.

2. The separation vacuum sealer, as recited in claim 1, wherein the installation groove comprises a notch located on a top surface of the base, wherein the flip cover structure is disposed at the opening of the installation groove.

3. The separation vacuum sealer, as recited in claim 2, wherein the flip cover structure comprises a flip cover pivotally connected with both sides of the opening of the installation groove, wherein the flip cover comprises a side plate and a bottom plate that are integrally injection molded to form an L-shaped structure, wherein the bottom plate has a flip base located at a bottom, wherein the flip base has a flip rail arranged thereon so that the flip cover flips along the flip rail, wherein the flip rail has two stop concave points respectively provided at two ends thereof, wherein the installation groove has a spring holding column mechanism fixedly installed in the opening thereof, wherein the spring holding column mechanism is located in the flip rail to limit the movement of the flip cover, and when the spring holding column mechanism is located at one of the two stop concave points, the flip cover structure fixes or lifts the handheld device.

4. The separation vacuum sealer, as recited in claim 3, wherein the stop concave points are respectively a lid closing concave point located at an upper end of the flip rail and a lid flip concave point located at a lower end of the flip rail.

5. The separation vacuum sealer, as recited in claim 3, wherein the spring holding column mechanism comprises a holding base locked at a bottom of the opening of the installation groove, a holding column passing through the holding base, and a return spring sleeved on the holding column.

6. The separation vacuum sealer, as recited in claim 1, wherein the handheld device comprises a casing, the vacuum pumping mechanism provided inside the casing, and a suction nozzle fixedly provided at an end of the casing and cooperating with the vacuum pumping mechanism, wherein the installation groove comprises a suction interface provided on an inner side wall thereof and cooperating with the suction nozzle, wherein the suction interface is connected with the air suction pipeline.

7. The separation vacuum sealer, as recited in claim 6, wherein a sealing ring is fixedly provided on the suction interface for grasping and sealing the suction nozzle, wherein the sealing ring is an arc-shaped silicone sealing ring.

8. The separation vacuum sealer, as recited in claim 6, wherein the handheld device comprises a battery module provided therein, wherein a key switch and a signal contact point for charging and signal control are arranged on the casing, wherein the installation groove comprises a signal contact element arranged therein and matched with the signal contact point.

9. The separation vacuum sealer, as recited in claim 6, wherein a plurality of friction protrusions are provided on side walls of both sides of the casing to abut against the inner side walls of both sides of the installation groove.

10. The separation vacuum sealer, as recited in claim 1, wherein a heating sealing mechanism provided on one side of the sealing cavity of the base, wherein the base has a sealing button provided thereon for controlling the heating sealing mechanism and a vacuum key provided thereon for controlling the vacuum pumping mechanism.

* * * * *